United States Patent [19]
Manley
[11] 4,266,918
[45] May 12, 1981

[54] APPARATUS FOR ELECTROSTATIC FIBRE SPINNING FROM POLYMERIC FLUIDS

[75] Inventor: Rockliffe S. Manley, Montreal, Canada

[73] Assignee: Pulp and Paper Research Institute of Canada, Pointe, Canada

[21] Appl. No.: 940,046

[22] Filed: Sep. 6, 1978

[30] Foreign Application Priority Data

Mar. 13, 1978 [CA] Canada ..... 298816

[51] Int. Cl.[3] ..... D01D 5/00
[52] U.S. Cl. ..... 425/66; 264/24; 264/176 F; 425/174.8 E
[58] Field of Search ..... 264/24, 176 F; 425/174.8 E, 66

[56] References Cited

U.S. PATENT DOCUMENTS

| | | | |
|---|---|---|---|
| 2,123,992 | 7/1938 | Formhals | 425/174.8 E |
| 2,158,415 | 5/1939 | Formhals | 425/174.8 E |
| 2,168,027 | 8/1939 | Gladding | 425/174.8 E |
| 2,303,341 | 12/1942 | Dufour et al. | 425/174.8 E |
| 2,636,216 | 4/1953 | Huebner | 425/174.8 |
| 2,810,426 | 10/1957 | Till et al. | 425/174.8 E |
| 2,908,545 | 10/1959 | Teja | 264/24 |
| 3,163,753 | 12/1964 | Sabato et al. | 264/24 |
| 3,461,943 | 8/1969 | Schile | 164/89 |
| 3,626,041 | 12/1971 | Fields et al. | 425/174.8 E |
| 4,043,331 | 8/1977 | Martin et al. | 264/24 |

FOREIGN PATENT DOCUMENTS

| | | | |
|---|---|---|---|
| 46-37769 | 11/1971 | Japan | 264/176 F |
| 47-33727 | 8/1972 | Japan | 264/176 F |
| 48-1466 | 1/1973 | Japan | 264/24 |

OTHER PUBLICATIONS

"Electrically Driven Jets", Taylor, Proc. Roy. Soc. London, A. 313, 453–475, (1969), London.

*Primary Examiner*—Jay H. Woo
*Attorney, Agent, or Firm*—Millen & White

[57] ABSTRACT

Method and apparatus are provided for producing a filament from molten rapidly crystallizing fibre-forming thermoplastic polymers. The apparatus includes a chamber for such molten crystallizable polymer having an electrically conductive orifice at one end of such chamber. Means are provided for applying sufficient pressure to the column of molten crystallizable polymer to form a flat meniscus at the orifice. An apertured plate of electrically conductive material (e.g. steel) is disposed a predetermined distance from the orifice. Finally, means are provided for applying a high voltage D.C. between the orifice and the apertured plate creating an electrostatic field which exerts a force on the column of the fluid (molten) polymer. Above a certain critical field strength the flat meniscus at the orifice is deformed into a conical shape from which a fine continuous jet of molten polymer is drawn. Subsequent crystallization of this jet yields a continuous fibre which can be drawn of otherwise treated in separate finishing operations so as to optimize its properties. Thus, the high pressure extrusion used in the past to form filaments is obviated.

17 Claims, 1 Drawing Figure

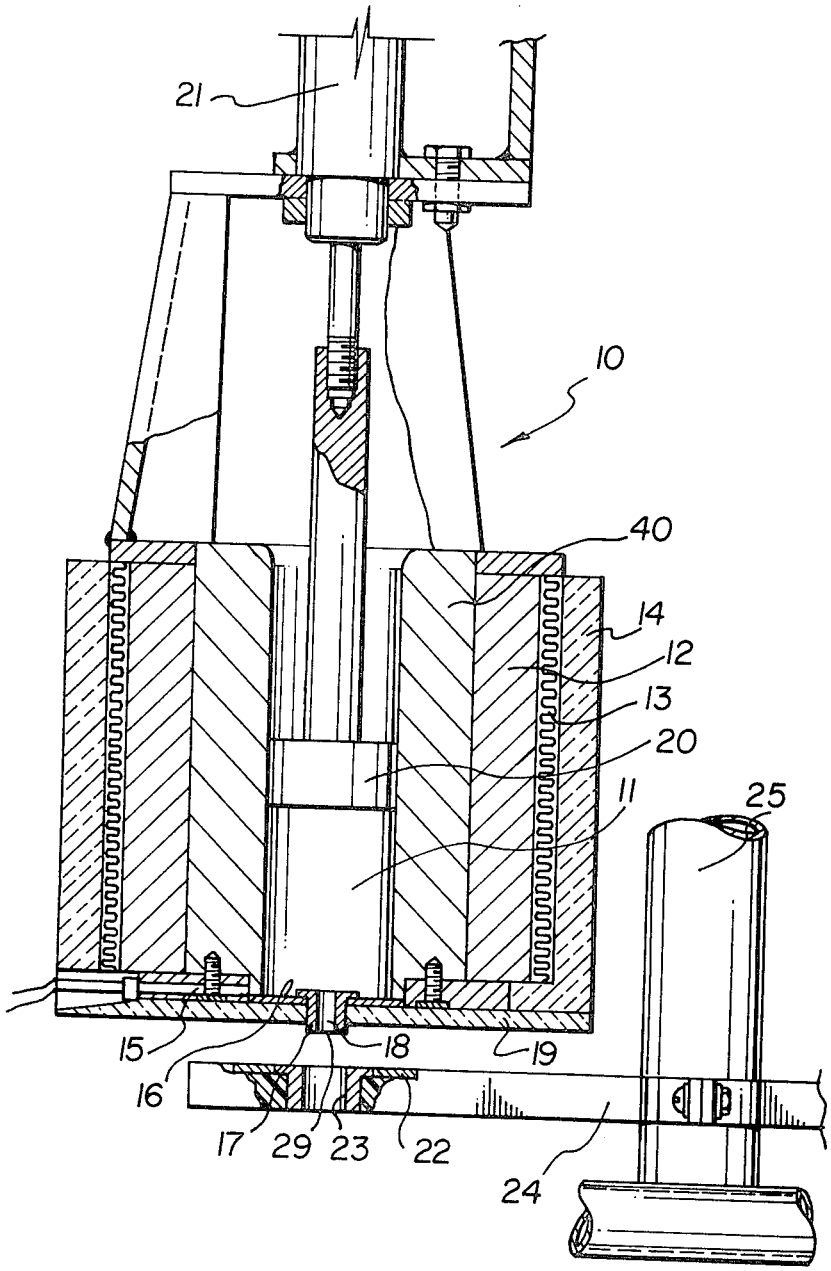
21
10
40
14
12
13
20
11
25
15
16
18
19
17
29
23
22
24

APPARATUS FOR ELECTROSTATIC FIBRE SPINNING FROM POLYMERIC FLUIDS

BACKGROUND OF THE INVENTION

1. Field of the Invention

This invention relates to method and apparatus for the spinning of fibres from molten polymeric fluids. More particularly, it relates to method and apparatus for the electrostatic spinning of fibres from molten rapidly crystallizing fibre-forming thermoplastic polymers.

2. Description of the Prior Art

Fibre spinning is the basis of a major world-wide industry. As is well known to those skilled in the art, in the conventional fibre spinning process, the polymer is melted and the molten polymer is then forced through a spinneret by some pumping mechanism, usually involving high pressures. This is followed by the cooling, drawing and winding up of the continuous filament on a spool. These spinning processes are broadly applicable to polyolefins, polyamides, polyesters and indeed to the whole range of rapidly crystallizing fibre-forming thermoplastic polymers.

As is also known to those skilled in the art, the usual method for producing an oriented polymer filament is to extrude molten polymer through an orifice and then to wind up the crystallized filament so produced at a rate faster than the extrusion velocity. An improvement in such process is taught in the Frank et al British Pat. No. 1,431,894, which provides method and apparatus in which the molten crystallizable polymer is forced through a constricted orifice at a sufficiently high pressure so as to produce a sufficiently high velocity gradient in the polymer in the region of the orifice along a line of uniaxial extension or pure shear that the temperature can be selected so as to provide continuous production of a core of crystalline polymer within the melt emerging from the orifice.

However, it is believed that such conventional spinning processes may be unsuitable for fibre spinning with very high molecular weight materials of all kinds, or with materials having very strong polar force bonding. It is believed that, for processes to involve the generation of a sufficiently high shear field to produce sufficient elongation flow in the polymer melt, the process would require a very high extrusion pressure. This can result in flow instability problems.

It is now known [see G. I. Taylor, "Electrically Driven Jets" Proc. Roy. Soc. London A 313,453–475 (1969)] that fine jets of monomeric liquids can be drawn from conducting tubes by electrostatic forces. As the potential of the conducting tube rises, the fluid becomes nearly conical and fine jets come from the vertices.

SUMMARY OF THE INVENTION

Aims of the Invention

Accordingly, it is an object of one aspect of this invention to provide an apparatus for the spinning of fibres from polymeric fluids in which high extrusion pressures are not necessary, by taking advantage of the principle of electrically driven jets.

An object of another aspect of this invention is the provision of a method for electrostatically spinning fibres from molten, crystallizable polymeric fluids.

STATEMENTS OF THE INVENTION

By one broad aspect of this invention, an apparatus is provided for producing a filament from a rapidly crystallizable molten polymer, the apparatus comprising: (a) a chamber for such molten polymer; (b) an orifice through an electrically conductive material at one end of such chamber; (c) means for applying sufficient pressure to such molten polymer to form a flat meniscus at the orifice; (d) an apertured plate of electrically conductive material disposed a predetermined distance from the orifice, the aperture of the plate being aligned with the orifice; and (e) means for applying a high voltage D.C. between the orifice and the apertured plate.

By another aspect of this invention, a method is provided for producing a filament from a rapidly crystallizable molten polymer which comprises: (a) providing a source of the polymer as a flat meniscus at an orifice within an electrically conductive member; and (b) applying an electrostatic force to such polymer, thereby to draw out the polymer from the orifice as a continuous jet of molten polymer.

OTHER FEATURES OF THE INVENTION

By one variant, the chamber is vertically disposed.

By another variant, the orifice is provided by an open-ended metallic capillary tube.

By another variant, the apparatus includes a source of D.C. voltage of from 10–30 KV.

By still another variant, the chamber is continuously fed with the molten crystallizable polymer by a screw conveyor.

By a further variant, the pressure in the chamber may be higher than necessary to form the flat meniscus, spinning of the fibre thus being by a combination of electrically driven jets and pressure extrusion.

By a still further variant, the apertured plate is an apertured metal plate adapted to be spaced from 1 to 5 cm below the orifice.

By another variant, the apparatus includes means for winding up solid filament as it emerges through the aperture in the apertured plate.

By still another variant, the winding means is adapted to wind up the solid filament at a speed greater than that at which it is formed.

By one variant, the method includes the steps of (c) allowing the molten polymer to crystallize as a filament and (d) winding up the solid filament.

By another variant, the method includes winding up the solid filament at a speed greater than that at which it is electrostatically formed.

By a further variant, the method is carried out on a molten polymer which is molten polyolefins, polyamides or polyesters, preferably polyethylene, polypropylene, or polyoxymethylene.

The present invention is therefore based on the principle of spinning a rapidly crystallizable polymer while it is in the molten fluid state by the application of an electrostatic field exerting a force on a thin column of the fluid polymer. In conventional fibre spinning processes, high pressures are utilized to extrude the polymer through an orifice. However, it is still within broad aspects of this invention to utilize sufficient pressure for extrusion, along with the electrostatic field to provide the filaments.

It should be emphasized that the process of the present invention should be less restricted in its application to high molecular weight polymers or polymer melts, because the destabilizing influence of the high pressures required by normal spinning processes is absent.

BRIEF DESCRIPTION OF THE DRAWINGS

In the accompanying drawing, the single FIGURE represents a schematic representation of an apparatus within the broad concepts of one aspect of this invention for carrying out the method of another aspect of this invention.

DESCRIPTION OF ONE EMBODIMENT

As seen in the drawing, the apparatus 10 includes a vertically oriented cylindrical chamber 11, whose walls 40 are desirably formed from stainless steel, the chamber being adapted to contain the molten polymer. The walls of the cylindrical chamber are surrounded by jacket 12, of aluminum, for good thermal conductivity, an electrically operated heater 13 and an insulating jacket 14, e.g. of asbestos. The chamber 11 is also provided with a thermocouple and heater 15, to measure and control the temperature.

The lower end 16 of the chamber 11 is provided with a tube 17, e.g. of stainless steel having a capillary opening 29 and an orifice 18. The bottom of the apparatus 10 is thermally insulated by means of a plate 19, e.g. of asbestos.

Disposed within the chamber 11 is a plunger 20, to exert sufficient pressure to the molten polymer in chamber 11 as heretofore described, forming a flat meniscus at the orifice 18. Plunger 20 is operated by a cylinder 21, e.g. an air cylinder, which preferably includes a double acting piston arrangement either to apply a downward force on the plunger 20, or to enable the plunger 20 to be withdrawn to refill and/or to clean the chamber 11.

While this particular structure of chamber is shown for a batchwise operation, it is preferred to have structure for a continuous operation. This may be achieved by feeding chamber 11 continuously by means of a screw conveyor from a hopper (not shown). Alternatively, chamber 11 may be continuously fed from a source (not shown) of the molten polymer under pressure.

A metallic plate 22 having an aperture 23 is supported on an electrically non-conductive arm 24, which in turn is supported on a shaft 25 and is adapted to be vertically adjustable, so that the distance between orifice 18 and plate 22 may be controlled.

DESCRIPTION OF OPERATION OF ONE EMBODIMENT

In operation, electrical connections (not shown) from a high voltage D.C. power supply are made to the tube 17 and to the metal plate 22. The voltage is generally of the order of 10–30 KV, although the amount of voltage depends on the molten polymer and on the spacing between the orifice and the apertured plate. Generally speaking, the applied voltage is large enough to overcome the static flat meniscus condition at the orifice and to form a cone terminating in a molten polymer jet. The maximum voltage is limited by the occurrence of electrical discharge between the orifice and the apertured plate. This, in turn, depends on the separation distance. Such distance usually varies between 1 and 5 cm, although other distances may be selected. In practice, the preferred field strength will fall in the range of 3 to 10 KV/cm.

The chamber 11 is charged with polymer and brought to the required temperature. When equilibrium is reached, the piston 20 is advanced down the barrel (chamber 11) with just sufficient force to push the molten polymer into the capillary opening 29, of tube 17 to orifice 18 and maintain a flat meniscus at its lower end. At this stage a potential difference is established between the tube orifice 18 and the apertured metal plate. When the voltage is gradually increased, the surface of the meniscus becomes convex until at a certain critical voltage, static equilibrium can no longer be maintained and the meniscus deforms, developing a pointed or conical end from which a fine continuous and stable jet of molten polymer is drawn. A short distance from the exit of the capillary orifice 18, crystallization of the molten polymer jet occurs and a continuous fibre is formed. The voltage is then shut off and the formed fibre is drawn either mechanically or by hand through aperture 23 in the apertured plate 22 and is secured to a wind-up apparatus (not shown). The critical potential is then reestablished, and the filament is then wound up on a spool rotating at an appropriate speed. The filaments can be removed and studied as desired.

DESCRIPTION OF EXAMPLES OF THE INVENTION

The following are examples of the methods of aspects of this invention.

EXAMPLE 1

The polymer used was high density polyethylene, known by the Trade Mark of Marlex 6009 (Philips Trade Mark). The temperature in the chamber was set at 200° C. The separation between the end of the capillary orifice and conducting metal plate was 3 cm. The length and diameter of the capillary orifice were 8.5 mm and 2.2 mm respectively. The critical potential for jet formation under these conditions was typically 12–15 KV. The diameter of the fibres was typically 0.1 to 0.2 mm. However, it should be noted that the fibre diameter decreases somewhat as the applied voltage is increased beyond the critical potential for the formation of a steady jet. The maximum voltage at which fibres can be spun is limited by the occurrence of electrical discharge between the end of the capillary orifice and the conducting plate and depends on the separation distance between these two elements.

The foregoing example has illustrated the method of an aspect of this invention as particularly applied to the production of single filaments. However, this example should not be considered to limit the potential uses of the method of aspects of this invention. Thus, in the apparatus described above, the single capillary orifice could be replaced by a multi-hole array so that several parallel filaments could be generated simultaneously.

EXAMPLE 2

The method describged above was carried out using polypropylene (known by the Trade Mark of Shell FE 6100, 0.5 melt index) instead of polyethylene. The temperature in the chamber was set at 210° C. and the critical potential for jet formation was 10–12 KV. Useful filaments of polypropylene were produced.

EXAMPLE 3

A series of polyethylene and polypropylene filaments were prepared for mechanical testing under conditions that are summarized in Table I. The tensile properties of the filaments were determined in an Instron tester at 65% humidity using a gauge length of 1 inch and a strain rate of 60%/min. The results are shown in Table II where average values of the tenactiy and initial modulus are given. The relatively low values of the tenacity and initial modulus are typically those of unoriented or very slightly oriented polyethylene or polypropylene fibres such as would be obtained in a conventional fibre spinning process under similar conditions. As is normal, the fibres can be drawn or otherwise treated in separate finishing operations in order to optimize crystallite orientation and tensile properties.

TABLE I

| Preparation of Fibre Samples for Mechanical Testing | |
|---|---|
| A. Polyethylene - MARLEX 6009 | |
| Control: | Polyethylene extruded using conventional high pressure equipment (take-up speed, approximately equal to extrusion speed) |
| PE-1: | Free spun at 23 KV. Electrode separation 3 cm. |
| PE-2: | Free spun at 17 KV. Electrode separation 3 cm. |
| PE-3: | Free spun at 21 KV. Electrode separation 3 cm. |
| PE-4: | Potential 19 KV. Electrode separation 2 cm. Spun under slight tension. Take-up speed 100 cm/min. |
| PE-5: | Potential 18 KV. Electrode separation 3 cm. Spun under slight tension. Take-up speed 4000 cm/min. |
| B. Polypropylene - Melt index 0.5 - SHELL 5220 | |
| Control: | Polypropylene extruded using conventional high pressure equipment (take-up speed, approximately equal to extrusion speed) |
| PP-1: | Potential 14 KV. Electrode separation 3 cm. Spun under slight tension. Take-up speed 500 cm/min. |
| PP-2: | Potential 12 KV. Electrode separation 2 cm. Spun under slight tension. Take-up speed 1000 cm/min. |
| PP-3: | Free spun at 14 KV. Electrode separation 3 cm. |

TABLE II

Physical Testing Data for Electrostatically spun Polyethylene and Polypropylene fibres

| SAMPLE NO. | TENACITY g/d | INITIAL MODULUS |
|---|---|---|
| Control | .28 | 8.30 |
| PE-1 | .07 | 7.96 |
| PE-2 | .14 | 9.28 |
| PE-3 | .06 | 7.83 |
| PE-4 | .12 | 6.91 |
| PE-5 | .17 | 9.49 |
| Control | .77 | 14.50 |
| PP-1 | .75 | 6.68 |
| PP-2 | 1.15 | 24.18 |
| PP-3 | .17 | 2.54 |

EXAMPLE 4

Tests were also made with the same polymer and apparatus (as in Example 1) but using a solution of the polymer in melted paraffin. The temperature of the chamber was set at 110° C. and the applied voltage was 15 KV. In this case composite fibres of polyethylene/-paraffin were obtained. When these fibres were placed in cold xylene, the paraffin was dissolved and after thorough washing with aliquots of fresh xylene, the residue was examined in a scanning electron microscope. The appearance was strongly reminiscent of the "shish-kebabs" obtained in the fibrous crystallization of polyethylene from stirred solutions as first described by Penning, A. J. and Kiel, A. M., Kolloid Z. Z. Polym. 205, 160 (165). These fibrous crystals are known to have a long thread of extended molecules (the shish) and closely packed transversely arranged lamellae (the kebabs) composed of folded chains. The central filament is thought to be the true primary nucleus, while the folded chain component arises from subsequent epitaxial overgrowth. The formation of fibrous crystals is closely connected with the existence during crystallization, of a flow component with a longitudinal velocity gradient. This type of gradient is believed to be very effective in extending and aligning the chain molecules.

I claim:

1. Apparatus for producing a continuous filament from a rapidly crystallizable high molecular weight molten polymer comprising:
   (a) a chamber for said polymer;
   (b) heating means associated with said chamber for melting said polymer and for maintaining said polymer in molten condition;
   (c) an electrically conductive material disposed at one end of said chamber, said electrically conductive member including an orifice formed therethrough, said orifice being an open-ended capillary tube unobstructed throughout the diameter thereof;
   (d) controllabel means for applying a preselected controlled pressure to said molten polymer, said controlled pressure being sufficient to form a static flat meniscus of said molten polymer at said orifice, but being insufficient to extrude said molten polymer out of said orifice;
   (e) an apertured plate formed of electrically conductive material disposed at a predetermined distance from said orifice, the aperture in said plate and said orifice being concentrically aligned; and
   (f) means electrically connecting one pole of a DC power supply to said electrically conductive material through which said orifice is formed, and connecting the other pole of said DC power supply to said apertured plate thereby to create an electronic static field between said orifice and said apertured plate, the value of the applied voltage being large enough to overcome said static flat meniscus at said orifice and to form a cone terminating in a molten polymer jet, but being insufficient to generate an electrical discharge between said orifice and said apertured plate.

2. The apparatus of claim 1 wherein said electrically conductive material includes only a single orifice therethrough, and whereby said apparatus produces a single continuous filament of said rapidly crystallizable molten polymer.

3. The apparatus of claim 2 wherein said chamber for said polymer is vertically disposed, with said orifice at the bottom thereof.

4. The apparatus of claim 2 wherein sid DC power supply provides a voltage of from 10–30 KV.

5. The apparatus of claim 2, further comprising a screw conveyor for feeding said chamber continuously with said rapidly crystallizable high molecular weight molten polymer.

6. The apparatus of claim 2 wherein said apertured plate is an apertured metal plate adapted to be spaced from 1–5 cm from said orifice.

7. The apparatus of claim 2 and further comprising means for winding up continuous solid filament formed beyond the aperture in said apertured plate.

8. The apparatus of claim 2 and further comprising a wind-up apparatus including a spool rotating at an appropriate speed for winding up continuous solid filament formed beyond the aperture in said apertured plate.

9. The apparatus of claim 8 wherein further comprising adjusting means for the wind-up speed so that said speed is just slightly greater than the speed at which said filament is formed, whereby said filament is wound under slight tension.

10. The apparatus of claim 2 wherein said D.C. voltage creates an electrical field between said orifice and said apertured plate having a strength of 3–10 kV/cm.

11. The apparatus of claim 2 wherein said capillary tube is 8.5 mm in length and 2.2 mm in diameter.

12. The apparatus of claim 4, wherein said D.C. power supply provides a voltage of 10–12 kV.

13. The apparatus of claim 4, wherein said D.C. power supply provides a voltage of 12–15 kV.

14. The apparatus of claim 2 wherein said means for applying sufficient pressure to the polymer comprises a hydraulically operated plunger.

15. The apparatus of claim 6 wherein said apertured plate is supported by an arm formed of an electrically non-conductive material, the linear distance of said arm from the orifice being adjustable.

16. The apparatus of claim 2, wherein said means for applying sufficient pressure to said molten polymer to form a flat meniscus at said orifice comprises a hydraulically operated plunger; and wherein said D.C. power supply provides a voltage of from 10 to 30 kV, said apparatus further comprising:

(f) an arm formed of an electrically non-conductive material supporting said apertured plate, the linear distance of said arm to said orifice being adjustable to space said apertured plate from 1 to 5 cm from said orifice.

17. The apparatus of claim 1 wherein said aperture in said apertured plate has a larger diameter than said capillary tube.

* * * * *